US009302136B2

(12) United States Patent
Lyszczarz

(10) Patent No.: US 9,302,136 B2
(45) **Date of Patent: *Apr. 5, 2016**

(54) THREE-POINT ADJUSTMENT MULTI-PURPOSE EXERCISE MACHINE

(71) Applicant: Grzegorz Lyszczarz, London (CA)

(72) Inventor: Grzegorz Lyszczarz, London (CA)

(73) Assignee: Hoist Fitness Systems, Inc., Poway, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/564,916

(22) Filed: Dec. 9, 2014

(65) Prior Publication Data

US 2015/0094193 A1 Apr. 2, 2015

Related U.S. Application Data

(63) Continuation of application No. 13/633,942, filed on Oct. 3, 2012, now Pat. No. 8,926,480, which is a continuation of application No. 13/275,355, filed on Oct. 18, 2011, now Pat. No. 8,308,620, which is a (Continued)

(51) Int. Cl.
*A63B 21/062* (2006.01)
*A63B 21/00* (2006.01)
(Continued)

(52) U.S. Cl.
CPC ..... *A63B 21/0013* (2013.04); *A63B 3/00* (2013.01); *A63B 21/00047* (2013.01);
(Continued)

(58) Field of Classification Search
CPC ..... A63B 21/154; A63B 21/062; A63B 21/1492; A63B 21/156; A63B 21/055; A63B 21/0552; A63B 21/1469; A63B 21/0557; A63B 21/1484; A63B 21/02; A63B 21/151; A63B 21/1496; A63B 21/4029; A63B 21/4043; A63B 21/4047; A63B 21/0622; A63B 21/0624; A63B 21/0626; A63B 21/0628; A63B 21/4035; A63B 21/4033; A63B 21/4049; A63B 23/12; A63B 23/03541; A63B 23/1245; A63B 23/03516; A63B 23/035; A63B 23/03533; A63B 23/1254; A63B 23/1263; A63B 23/1272; A63B 2208/0233; A63B 2225/09; A63B 2225/093; A63B 2225/102; A63B 2021/0623; A63B 22/0002; A63B 22/0005; A63B 22/0015; A63B 22/0048; A63B 22/0056
USPC ..... 482/42, 92–103, 121–130, 133–134, 482/138–139, 908
See application file for complete search history.

(56) References Cited

U.S. PATENT DOCUMENTS 3,746,338 A * 7/1973 Proctor ..... A63B 21/062 482/101
4,456,246 A * 6/1984 Szabo ..... A63B 21/06 482/98

(Continued)

FOREIGN PATENT DOCUMENTS

DE 4331733 5/1995
DE 19704390 A1 9/1997

(Continued)

*Primary Examiner* — Oren Ginsberg
*Assistant Examiner* — Joshua Lee
(74) *Attorney, Agent, or Firm* — Jones Day

(57) ABSTRACT

A multipurpose exercise machine requiring only three points of adjustment centrally located. It has a one point height adjustment and two adjustments for the rotating arm assemblies. Dip and chin up bars are attached to the arm assemblies. The machine contains an integrated swingable workout bench. Through the use of a pulley system and counter balance assembly, the cable system maintains tension and provides a constant length of cable.

23 Claims, 12 Drawing Sheets

Related U.S. Application Data continuation of application No. 12/185,919, filed on Aug. 5, 2008, now Pat. No. 8,057,368.

(60) Provisional application No. 60/963,497, filed on Aug. 6, 2007.

(51) Int. Cl.
*A63B 3/00* (2006.01)
*A63B 23/12* (2006.01)

(52) U.S. Cl.
CPC ..... *A63B 21/0628* (2015.10); *A63B 21/156* (2013.01); *A63B 21/4023* (2015.10); *A63B 21/4029* (2015.10); *A63B 21/4035* (2015.10); *A63B 21/4043* (2015.10); *A63B 21/4047* (2015.10); *A63B 23/1218* (2013.01); *A63B 23/1227* (2013.01); *A63B 2208/0204* (2013.01); *A63B 2208/0233* (2013.01); *A63B 2225/093* (2013.01)

(56) References Cited

U.S. PATENT DOCUMENTS 4,603,855 A * 8/1986 Sebelle ..... A63B 21/06 482/103
4,634,127 A * 1/1987 Rockwell ..... A63B 21/062 297/118
4,711,448 A 12/1987 Minkow
4,733,858 A 3/1988 Lan
4,898,381 A * 2/1990 Gordon ..... A63B 21/00072 482/103
4,911,435 A 3/1990 Johns
5,195,937 A * 3/1993 Engel ..... A63B 21/015 482/116
5,201,694 A * 4/1993 Zappel ..... A63B 21/00072 482/133
5,352,170 A 10/1994 Condo
5,605,524 A 2/1997 Husted
5,906,566 A * 5/1999 Whitcomb ..... A63B 21/0552 482/130
D439,941 S * 4/2001 Batca ..... D21/675
6,217,483 B1 * 4/2001 Kallassy ..... A63B 21/068 482/38
6,443,877 B1 9/2002 Hoecht
6,488,612 B2 12/2002 Sechrest
6,592,498 B1 * 7/2003 Trainor ..... A63B 21/062 482/46
7,066,866 B1 * 6/2006 Mobley ..... A63B 1/00 482/40
7,503,880 B2 3/2009 Campanaro
7,517,304 B1 4/2009 Swanson
7,575,538 B1 * 8/2009 Clark ..... A63B 21/062 482/103
7,601,105 B1 10/2009 Gipson
7,604,576 B2 10/2009 Drechsler
7,654,942 B1 * 2/2010 Batca ..... A63B 21/062 482/135
7,922,629 B1 4/2011 Batca
7,976,442 B2 * 7/2011 Quinn ..... A63B 21/0613 482/100
8,096,926 B1 * 1/2012 Batca ..... A63B 21/00058 482/92
8,172,733 B1 * 5/2012 Batca ..... A63B 21/062 482/93
2003/0017918 A1 * 1/2003 Webb ..... A63B 21/062 482/94
2003/0100413 A1 * 5/2003 Huang ..... A63B 21/1434 482/100
2005/0202941 A1 * 9/2005 Vaes ..... A63B 21/0613 482/94
2005/0209070 A1 * 9/2005 Greenland ..... A63B 21/078 482/97
2006/0035764 A1 * 2/2006 Webber ..... A63B 21/06 482/94
2006/0100069 A1 * 5/2006 Dibble ..... A63B 21/045 482/98
2006/0160674 A1 * 7/2006 Andrews ..... A61H 1/0281 482/92
2007/0037674 A1 2/2007 Finn
2007/0161469 A1 * 7/2007 Lamle ..... A63B 21/00181 482/94
2007/0184944 A1 * 8/2007 Huang ..... A63B 21/06 482/94
2007/0270293 A1 * 11/2007 Zhuang ..... A63B 21/023 482/123
2007/0287607 A1 * 12/2007 Koyama ..... A63B 21/062 482/100
2008/0096735 A1 * 4/2008 Grider ..... A63B 21/062 482/99
2008/0300116 A1 * 12/2008 Eder ..... A63B 21/062 482/100
2009/0170668 A1 7/2009 Giannelli et al.

FOREIGN PATENT DOCUMENTS

DE 19801672 A1 11/1998
EP 1658884 A1 5/2006
JP 5-76620 A 3/1993
JP 8-266683 A 10/1996
JP 08266683 A 10/1996
JP 05076620 A 3/1997

* cited by examiner

THREE-POINT ADJUSTMENT MULTI-PURPOSE EXERCISE MACHINE

CROSS-REFERENCE TO RELATED APPLICATIONS

This application is a continuation of U.S. patent application Ser. No. 13/633,942, which was filed in the U.S. Patent and Trademark Office on Oct. 3, 2012. Application Ser. No. 13/633,942 is a continuation of U.S. patent application Ser. No. 13/275,355, which was filed in the U.S. Patent and Trademark Office on Oct. 18, 2011, and has issued as U.S. Pat. No. 8,308,620. Application Ser. No. 13/275,355 is a continuation of U.S. patent application Ser. No. 12/185,919, which was filed in the U.S. Patent and Trademark Office on Aug. 5, 2008, and has issued as U.S. Pat. No. 8,057,368. Application Ser. No. 12/185,919 claims the benefit of provisional U.S. patent application Ser. No. 60/963,497, which was filed in the U.S. Patent and Trademark Office on Aug. 6, 2007. This application claims priority to each of the aforementioned applications, which are incorporated herein by reference.

STATEMENT REGARDING FEDERALLY SPONSORED RESEARCH OR DEVELOPMENT

This application is not the subject of any federally sponsored research or development.

THE NAMES OF THE PARTIES TO A JOINT RESEARCH AGREEMENT

There have been no joint research agreements entered into with any third parties.

FIELD OF THE INVENTION

This invention relates to exercise machines, specifically multipurpose exercise machines used for strength, aerobic, stretching or rehabilitation exercises.

BACKGROUND OF THE INVENTION

Multi-functional weight training equipment which enables multiple exercise routines in various positions on a single machine has been designed in the past. Exercise devices that have been prevalent in recent years, commonly known as functional trainers, use adjustable components in order to create new positions for exercise. Thanks to their ability to transform themselves into different configurations, they can mimic most of the traditional multi-station machines and free weights with just a few adjustments. There are many types of functional trainers on the market today, and they use several different methods for adjusting their components. Most of them use adjustable arms, sliding carriages with pulleys or multiple pulleys mounted at different locations on the machine. Also, some of them can be used with the workout bench. The number of exercises that can be performed on particular machine depends on how many different configurations it can be transformed to. More configurations provide more exercise options for the user. The goal is to create as many new positions for exercise as possible with the use of a single machine. Recently there have been some attempts to incorporate the use of functional trainers with workout benches. This is a very desirable combination because it provides additional exercise options and with support of the bench, higher resistance can be used. There is a big demand for such versatile equipment, especially in the fast growing market of home gym fitness.

Unfortunately, the majority of these devices are large, cumbersome and difficult to handle. Some of them have limitations on positions available for exercise, and others have complicated and time consuming adjustments. Most of them lack versatility and are used only for strength exercises with one mode of resistance. Machines that combine a stationary bench with a functional trainer have limitations because the presence of the bench prohibits many exercises.

For example, U.S. Pat. No. 6,238,323, Nordic Track® 360° Home Gym, and Nordic Track® PT3 Trainer represent a group of functional trainers that use similar methods of adjusting their components to create new positions for exercise. They all use very long and stationary mounted adjustable arms that can rotate 180 degrees about a generally horizontal axis to different locked positions. These are adjusted such that their ends are very close together at the top and bottom of their arcs (arms in vertical position) and are widely spread when the arms are in the middle of their arcs (arms in horizontal position). The shortcoming of the described method of adjustment is that there are limitations on the positions that their arms can take. More specifically they are not suitable for exercises that require the ends of the arms to be relatively close together and at about waist height of the exerciser (such as a typical rowing movement). Also, changing the height of the arms requires adjustments at two locations. Arms are very long (in order to provide for high and low pulley exercises) and awkward to handle. With the arms in a vertical position, there is not enough room in front of the machine for exercises that require pure vertical resistance (lat pull down, military press, squat) and user have to adjust their body position for these particular exercises, applying a vertical and an unnecessary horizontal force.

A different method for creating new positions for exercise is used in exercise machines presented in United States Patent Application Publication Numbers US 2003/0017918 A1 and US 2002/0013200 A1 (Known as Cybex FT360S) and commercially available Northern Lights Chilcat Cable Motion Trainer, Vectra VFT 100, Tuff Stuff MFT-700 and Paramount Functional Trainers Models PFT-200 and FT-150. With this method of adjusting the arms, narrow and wide grips at different heights are available, which greatly increases number of possible positions for exercise. Arms can rotate about a generally horizontal and vertical axis to different locked positions such that their ends move in three dimensional manners. Because of that the users are forced to move closer or further away from the machine for different exercises. For example, for exercises that require the ends of the arms to be relatively close together and at about waist height (such as a typical rowing movement) the distance between the user and the machine will be equal to the length of the arms.

The shortcomings of the described adjustment method are that three dimensional changes in the position of the very long arms require a lot of extra space, which is often not available. Three dimensional adjustments can be confusing, awkward and can intimidate new users or potential buyers. Creating new positions for exercise using three dimensional systems require adjustments at four locations, two for changing the height and two for changing the width of the arms which can be complicated and time consuming, especially for multiple consecutive users of different sizes (height).

The use of the bench with three dimensional arm positioning method requires changes of the bench position almost with every new arm location. Repositioning of the bench involves multiple lifting and can be time consuming and tiring.

Another method of adjusting components of the exercise machine to create new positions for exercise is presented in U.S. Pat. No. 6,447,430 B1, which shows the machine having two weight stacks, a pair of carriages mounted on the frame and adopted to be adjusted to different heights and pulley blocks on the carriages. Each of the pulley blocks are free to pivot about two axis of rotation so that the pulley blocks can follow the cables and remain aligned with the cables regardless of the direction in which the cables are pulled. The shortcomings of the machine described above are that the system is using complicated three dimensional adjustments of the arm position. Locations for adjustments are distant from each other and placed on two separate posts, forcing the user to walk between them to complete the desired changes, which can be time consuming. Height adjustment requires changes at two separate locations distant from each other. In order to change the height and the width, the user has to complete a total of four adjustments at two separate locations distant from each other, which is complicated and time consuming. The machine has a large structure because it uses two posts for height adjustment and two separate weight stacks, which greatly adds to the weight of the entire assembly. Carriages are heavy to handle and placing them at the highest level is difficult because adjustment points are above the head of the average size user.

The arms of this machine swing in a horizontal plane, and because of that the maximum available height for exercise is limited by the height of the posts with the sliding carriages. Despite that the machine is built very tall, even at the highest position of the carriages, the highest position for exercise is at face level for the average sized user.

The machine is equipped with a dip bar and a chin up bar, but because they are installed at a fixed height they might be difficult to use for a below average size user. They provide only one fixed resistance equal to the body weight of the user, which might not be suitable for many beginner or intermediate level exercisers. Similar methods of adjustments as described in U.S. Pat. No. 6,447,430 B1 may be seen in machines like Body-Solid Functional Training Centre GDCC200, Northern Lights Functional Trainer, Pacific Fitness 3.23 Functional Trainer, Torque Fitness F5 and Life Fitness FSDAP.

Up to this time, there have been some attempts of combining machines that provide many exercise options by using the adjustability of their components with bench exercises. Combinations like this can provide exercises with more resistance from different locations and directions with user defined paths of exercise movements. Some machines have even added body weight exercises using dip bars, and/or a chin-up bar.

Examples of machines that combine a functional trainer with the use of a bench are for example Bowflex Revolution that provides machine with two arms that can rotate 180 degrees about a horizontal axis mounted at a fixed level behind a multi functional and adjustable exercise bench. Nordic Track® PT3 and Nordic Track® 360° Home Gym uses the same principals for arm adjustments like Bowflex Revolution but have higher mounted and longer arms and have a removable seat instead of a fold up bench.

Other examples are Body Craft mini/XPress and Body Craft XPress Pro which consist of two arms that can rotate 180 degrees and are mounted behind a seated exercise bench. Arms are much shorter (than Bowflex Revolution and PT3) and are located at a lower level. All of them use similar arm adjustment methods which does not provide positions for exercises that require starting points inside of the circle described by the ends of the arms. Specifically, the only available positions for exercise are located on the circumference of that circle. Therefore, the major shortcoming of these machines is the limitations on the positions that their arms can take. More specifically, they are not suitable for exercises that require narrow grip at about waist height for the exerciser (such as typical rowing movement). Also, the machines are relatively low for many standing exercises and because the arms are configured too close to the front of the machine there is not enough space for exercises that require pure vertical resistance. Despite that the bench folds up for storage it prevents the user from performing many user defined exercises, or these exercises must be done in awkward body positions.

Because their arms rotate generally in vertical plane, they do not provide enough room for exercises that require pure vertical resistance (squats, military press). In order to utilize those exercises, extra floor pulleys need to be used, or exercisers have to adjust their body positions to align with the angle of the cable.

Another shortcoming of these machines is that they do not economically use the length of the cable. This is mainly because the starting positions of many exercises that are often distant from the ends of the arms. Available cable length is reduced by the distance between the starting position for exercise and the ends of the arms.

The presence of the bench during exercises that do not require the use of the bench prohibits many exercises and many of them have to be performed in awkward positions. The removable seat of the PT3 machine does not provide enough adjustability. The arms of Body Craft mini/XPress do not provide for high pulley exercise and due to this, additional lat pull down assembly had to be added.

Body weight exercises are very popular, effective and are often recommended as an additional variation in anybody's workout routine. Prior art machines have been designed in the past that incorporate dip bars and chin up bars as sub-assemblies built into a main structure of a multi-purpose exercise machine. Usually they are built as an addition to the entire structure or in the form of a fold up design.

Shortcomings of such an arrangement are that it increases the size and the cost of the unit, beside that, most of the prior art dip bars and chin up bar assemblies are installed at fixed heights and they might be difficult to use for a below average size user. Also, they provide one fixed resistance equal to the body weight of the user which might not be suitable for many beginner or intermediate level exercises.

SUMMARY OF THE INVENTION

A 3 point arm adjustment multipurpose exercise machine is disclosed which provides a very effective method of creating new positions for exercise. The new machine can provide different height positions for arm exercises combined with different configurations of the adjustable arms providing multiple widths for low and high pulley exercises as well as multiple heights for narrow and wide grip exercises. All of the prior art machines require adjustments at four locations (points) to achieve a similar number of positions available for exercise.

One point height adjustment with unchanged configuration of arms greatly shortens transition time between exercises and can simplify more complex workout routines, such as circuit training With one point height adjustment, exerciser can switch in seconds from low to mid or even high pulley exercises which with prior art, equipment would require at least two separate adjustments.

The present machine provides a very simple adjustment system, which makes all the adjustments for new positions for exercise easily predictable by the exerciser and it greatly simplifies the use of the bench which does not need to be moved to fit new arm positions.

Arms adjustments can be made with three adjustment points placed at one convenient location. High pulley level can be adjusted by each exerciser to meet their individual needs. With the presented adjustment method for creating new positions for exercise, handles at the ends of arms can be brought within a view inches from the starting position for exercise which allows for greater economical use available for exercise cable length. This ability can be used and appreciated in the fields of rehabilitation and physiotherapy where precise positioning, proper form and execution of the path of the exercise is very important.

Another advantage of the present invention is that it offers a wide range of bench exercises as well as freeing space when bench is not needed. The bench can swing from the storage position to exercise position.

The present invention may have one or more of the following advantages: It has a reduced number of adjustment points; it has new uses for traditional components; it is more versatile; it has simpler, faster, easier to handle and accessible from one location adjustments; it has a one point height adjustment; it offers full range of undisturbed bench or functional exercises without sacrificing their proper form; one adjustable structure can be used for different types of workout and with different modes of resistance; various lifting or pulling exercises that require pure vertical resistance can be performed without additional attachments or changing of the body position of the exerciser; provides multiple positions and adjustable resistance for body weight exercises; can be used with at least one swing-away workout station; and it has more economical use of the cable length.

BRIEF DESCRIPTION OF THE DRAWINGS

The accompanying figures depict and disclose examples of the invention and examples of various positions and uses of the invention wherein.

DETAILED DESCRIPTION OF THE INVENTION

The present invention will now be described more fully, in which preferred embodiments of the invention are shown. The disclosed embodiment is merely exemplary of the invention, which may be embodied in various forms. Therefore the details disclosed herein are not to be interpreted as limited, but merely as the basis for the claims and as a basis for teaching one skilled in the art how to make and/or use the invention.

Figure 1:
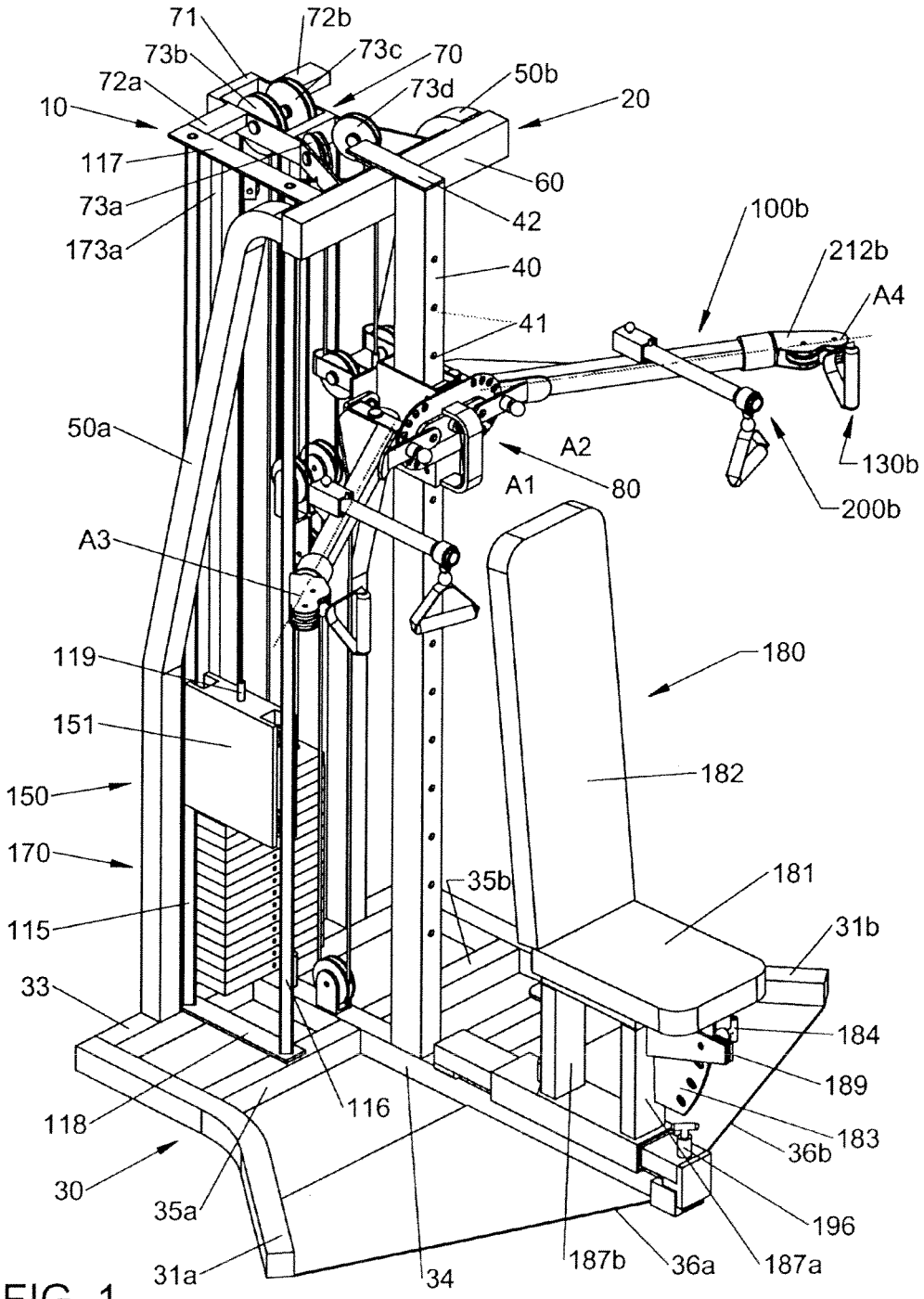
FIG. 1 is a front right perspective view of an embodiment of the exercise machine of the present invention, with the arms in a generally horizontal position.

With reference to FIG. 1, from the view point of the exerciser sitting on bench assembly 180 with back resting on the back support 182, the assemblies and components on the "right" side of the exercise machine 10 will be denoted by suffix "a", and the "left" side of the exercise machine 10 will be denoted by suffix "b".

Figure 2:
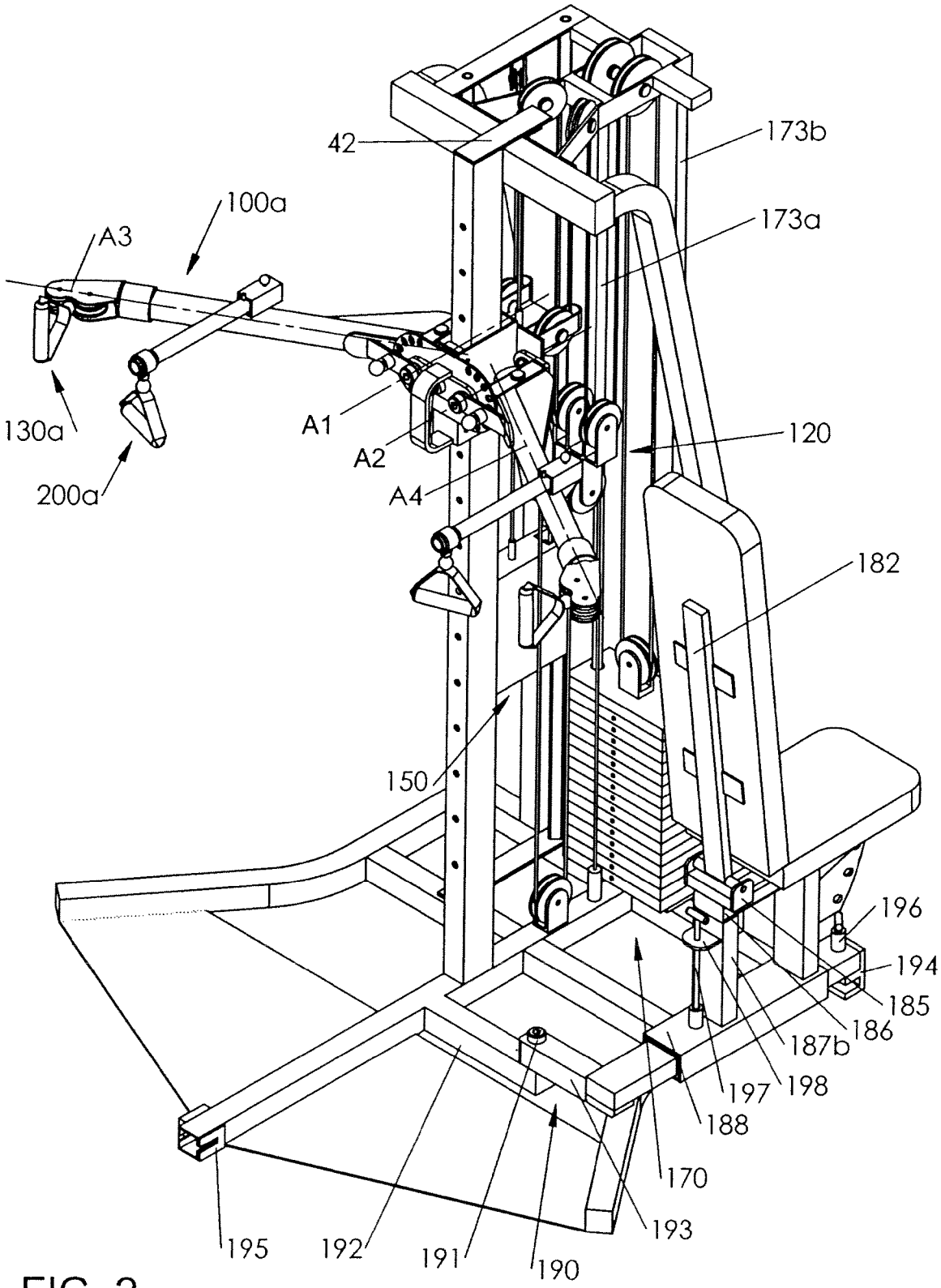
FIG. 2 is a front left perspective view of the exercise machine with the swing away workout station in a generally retracted position.

With reference to FIG. 1 and FIG. 2, a multipurpose exercise machine 10 is disclosed. The exercise machine 10 further includes major features, namely, an upstanding frame 20, a carriage and arm assembly 80 with two rotating arm assemblies 100*a*, 100*b*, a pair of handle units 130*a*, 130*b*, a pair of adjustable chin-up and dip bar assemblies 200*a*, 200*b*, a counterbalance assembly 150, a cable length compensator assembly 120, a weight stack assembly 170, and a swing away workout station 190.

The frame further consists of a base 30, a vertical centre-post 40, two vertical support posts 50*a*, 50*b*, a upper frame reinforcement 60, and an upper pulley assembly 70.

The base 30 further consists of two side members 31*a*, 3 lb connected via cross member 33. Base plate 36*a* and 36*b* is connected to two side members 31*a* and 31*b*. The central reinforcement 34 is connected at the midpoint of cross member 33. Two small cross members 35*a*, 35*b* are connected in line and in between side members 31*a*, 31*b*. The lower end of vertical centre post 40 is connected to central reinforcement 34 and its upper end is attached to the midpoint of the upper frame reinforcement 60. Both ends of the upper frame reinforcement 60 are connected to the second ends of the vertical support posts 50*a*, 50*b*. The first ends of the vertical supports 50*a*, 50*b* are mounted to the cross member 33.

Referring to FIG. 1, upper pulley assembly 70 comprising a pulley mount 71, guide rod mounting brackets 72*a*, 72*b*, and pulleys 73*a*, 73*b*, 73*c*, 73*d* which are mounted via bolts to the pulley mount 71.

Figure 3A:
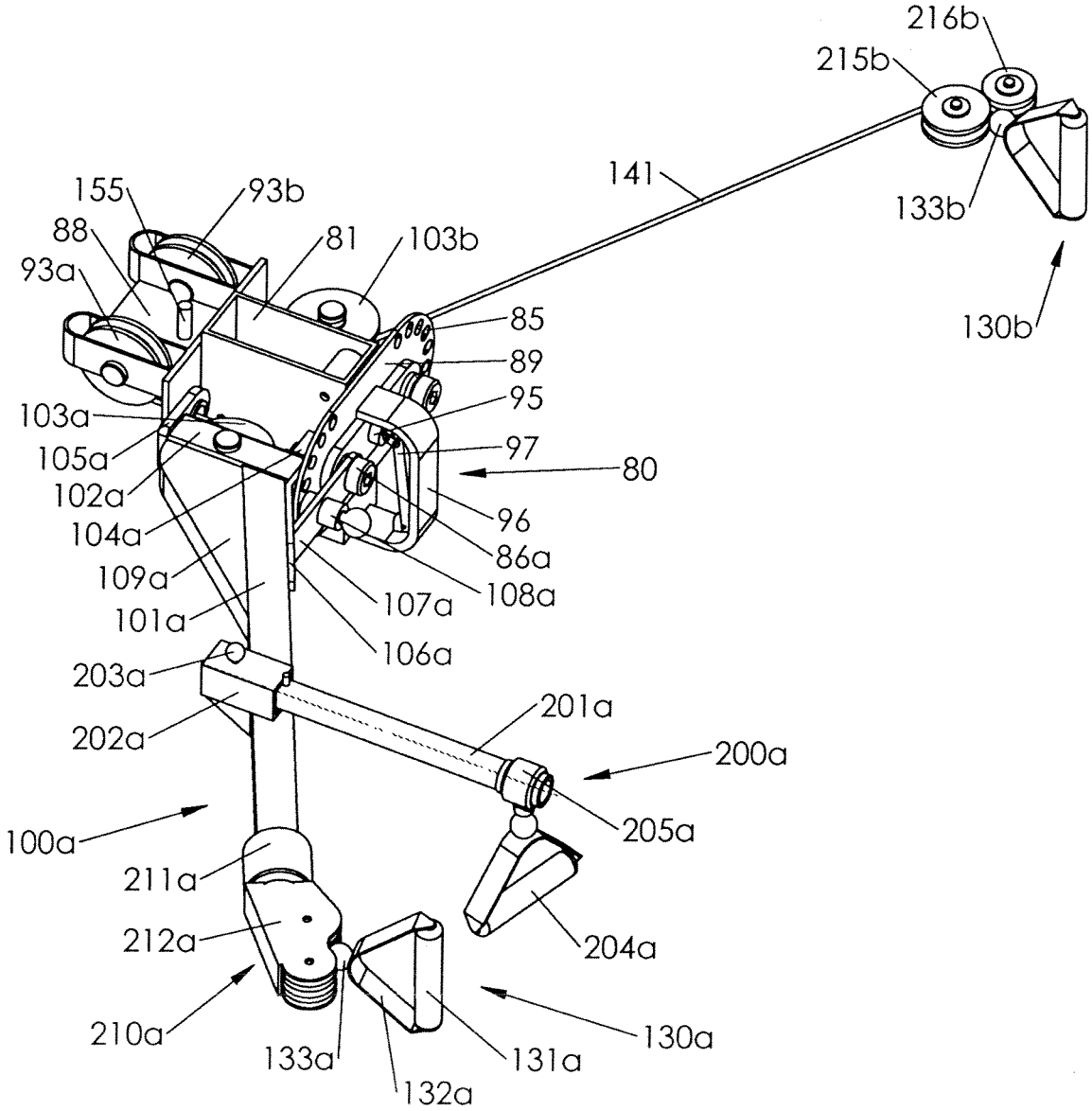
FIG. 3*a* is a perspective view of the carriage with one arm hidden, showing carriage components in greater detail.

Referring to FIG. 1, 4, counter balance assembly 150 will be described. The counter balance assembly 150 comprising a counter weight 151 with guide rollers 152*a*, 152*b*, 152*c*, 152*d* operatively connected with guide rails 115, 116. Guide rails 115, 116 are positioned vertically and parallel to each other. Upper and lower reinforcements 117, 118 mount together guide rails 115, 116 at the lower end to the small cross member 35*a* and cross member 33, and to upper reinforcement 60 and guide rail mounting bracket 72*a* at the upper end. Cable anchor 119 connects the first end of cable 142 to the counter weight 151. Cable 142 extends over transfer pulleys 153, 154 and connects via cable anchor 155 to the upper surface of pulley mount 88 of carriage and arm assembly 80 (FIG. 3*a*). Counterbalance cable 142 interconnects counter weight 151 with carriage and arm assembly 80.

Referring now to FIG. 1, 2, 4, 5. The weight stack assembly 170 which is mounted on cross member 33, comprising a operating rod 171 , a weight stack pulley 176 connected to the operating rod 171 , a plurality of weight plates 172 which are mounted on guide rods 173*a*, 173*b* with their bottom ends mounted on cross member 33. Operating rod 171 and weight plates 172 have aligned openings 174 through which a pin 175 can be inserted to connect any of the weight plates 172 to operating rod 171. When a given weight plate 172 is connected to operating rod 171, that plate and any plates above it will be lifted with the operating rod 171.

The upper ends of the guide rods 173*a*, 173*b* of weight stack assembly 170 are attached to brackets 72*a*, 72*b* of the second end of upper pulley assembly 70. The first end of upper pulley assembly 70 is attached to the midsection of upper reinforcement 60.

Those skilled in this art will recognize that although a weight stack is the preferred structure for providing resistance to the exerciser, other resistance-imparting structures such as friction-imparting devices, variable viscosity devices, air drag-based resistance devices, pneumatic devices, elastically bending rods, gas springs, magnetic devices, hydraulic devices, and the like, may also be employed with an exercise machine of the present invention.

Figure 3B:
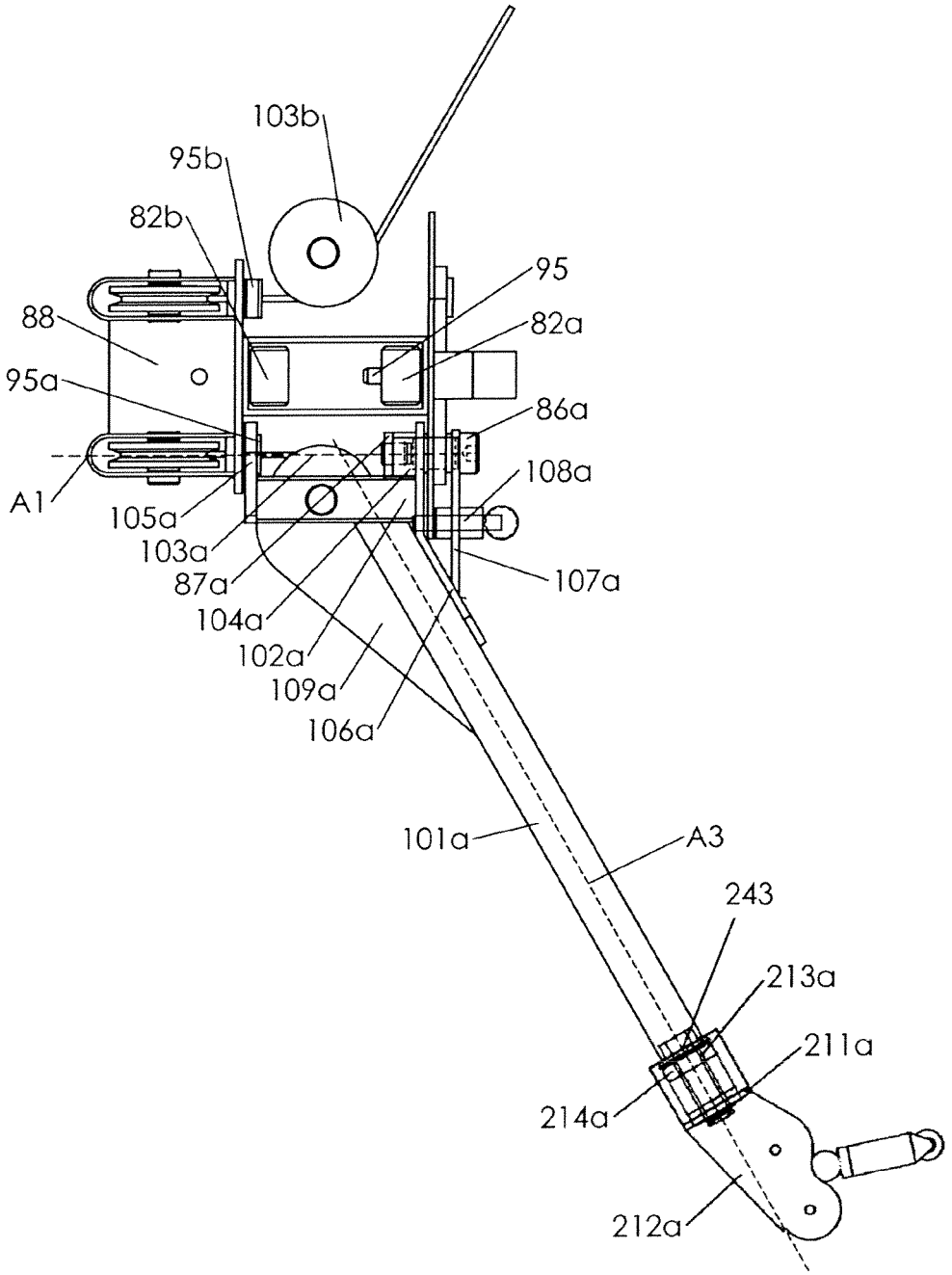
FIG. 3*b* is a top view of the carriage with one arm hidden, showing arm mountings, bushings and carriage rollers along the handle pulley assembly showing components in greater detail.
Figure 9:
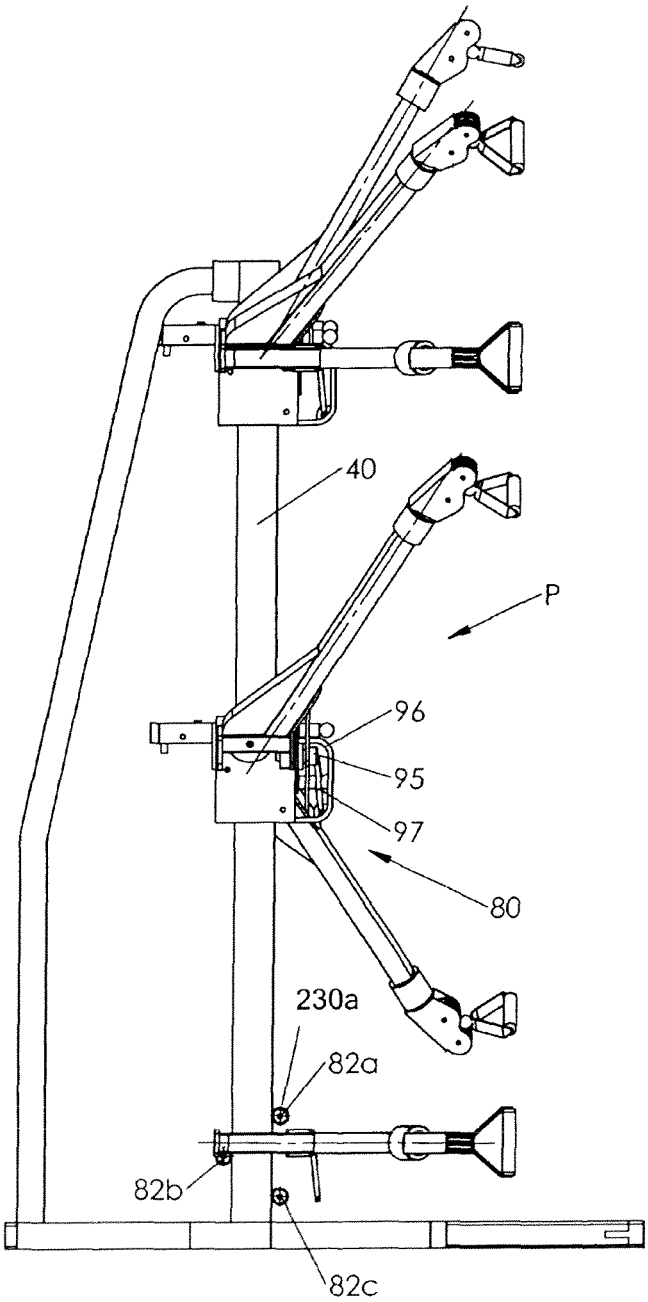

Referring to FIG. 3*a*, 3*b*, 9, the carriage and arm assembly 80 comprising a sleeve 81 with rollers 82*a*, 82*b*, 82*c* (FIG. 9), bolt 230*a*, arm selector plate 89 and pulley mount 88. Sleeve 81 and rollers 82*a*, 82*b*, 82*c* are operatively connected via bolts. Rollers 82*a*, 82*b*, 82*c* are positioned and sized to provide for rolling operation between carriage and arm assembly 80 over the vertical centre post 40. Arm selector plate 89 with both ends semicircular in shape includes near its perimeter a series of position apertures 85 arranged in a semi-circle at circumferential increments of 22.5 degrees, although other increments are also suitable. Circular holes (where bolt 86*a* is inserted) in the arm selector plate 89 are coincident with the holes in the pulley mount 88 and axis A1 to provide mounting and rotation points for arm assembly 100*a* about the axis A1. The centre of the semi-circle defined by the apertures 85 is also coincident with axis A1. Cable anchors 155 and 156 (FIG. 4) are mounted on the top and bottom of the horizontal plate of the pulley mount 88. Pulleys 93*a*, 93*b*, are attached via bolts to the pulley mount 88. The axis of rotation of pulleys 93*a*, 93*b* are perpendicular to axis A1 and positioned such that the axis of the cable 141 when engaged with pulleys 103*a*, 103*b*, coincides with axis A1. In this arrangement, rotation of the arm assembly 100*a* about axis A1 does not change tension in the cable 141. A carriage selector pin 95 is operatively connected with handle 96 via linkage 97 and spring (not shown). Insertion of carriage selector pin 95 into one of the height position apertures 41 in the centre post 40 prevents vertical movement of the carriage and arm assembly 80. The carriage and arm assembly 80 may be locked in any position along the vertical centre post 40 and such locked positions may be of any size (4 inches shown).

The arm assemblies 100*a*, 100*b* are mirror images of one another about a vertical plane as shown in FIG. 3*a* that extends through the centre of the carriage and arm assembly 80. In the interest of clarity and brevity, only one arm assembly 100*a* will be described in detail herein; those skilled in this art will appreciate that this discussion is applicable to the arm assembly 100*b*.

Referring now to FIG. 3*a*, 3*b*, the arm assembly 100*a* further includes arm 101*a* with arm reinforcement 109*a* connected at its mounted end to the arm mounting bracket 102*a* consisting of front and rear supports 104*a*, 105*a*, respectively, pulley 103*a* rotatably mounted between them, a front reinforcement 106*a*, and a bracket 107*a* with spring loaded arm selector pin 108*a*. The centre of the circular holes in the front support 104*a*, rear supports 105*a*, front reinforcement 106*a*, and the unattached end of bracket 107*a* are coincident with axis A1 (FIG. 1, 2) and provide mounting and rotation points for the arm assembly 100*a* about axis A1. The spring loaded arm selector pin 108*a* is mounted in the midsection of the bracket 107*a* and the pin is sized and configured such that in its extended position can be received in one of the position apertures 85 and in the openings of the front reinforcement 106*a*. Insertion of the pin into one of the position apertures 85 and opening in the front reinforcement 106*a*, prevents rotation of the arm assembly 100*a* about the axis A1. Retracting the pin 107*a* from one of the position apertures 85 and openings in the front reinforcement 106*a* makes rotation of the arm assembly 100*a* about axis A1 possible.

Arm assembly 100*a* is rotatably mounted with the carriage and arm assembly 80 about axis A1 (FIGS. 1, 2) via bolt 86*a* at the front end and sleeve bushing 95*a* at the rear end. Locking nut 87*a* secures the connection and enables adjustment of the rotational resistance by tensioning of nut 87*a* and bolt 86*a*.

As shown in FIG. 1, 2, the arms extend forward at a chosen angle from a pivot point located on the carriage and arm assembly 80. FIG. 9 shows the arms angled at 30° from the vertical, but those skilled in the art will recognize that any practical purposely chosen angle can be applied without departing from the spirit of the invention. That is, the arms are angled forward to provide enough space for performing standing or seated exercises when a pure vertical resistance is required to deliver proper exercise form in exercises such as shoulder presses or standing squats.

Referring to FIG. 1, 2, 3*a*, 3*b*, removable chin-up and dip bar assemblies 200*a*, 200*b* are attached at the mid-section of arm assemblies 100*a*, 100*b* respectively. Bar assembly 200*a* comprising a bar 201*a* and sleeve 202*a* which are fixed to the mid-section of the arm 100*a*. Bar 201*a* can be removed or attached to the arm 100*a* using pin 203*a*, connecting sleeve 202*a* with bar 201*a*. Bars are in a generally horizontal position and can be adjusted to various widths by rotating arm assemblies 100*a*, 100*b* about axis A1, A2 and securing with selector pin 108*a* to the selector plate 89. The height of the bars 200*a*, 200*b* can also be adjusted by changing height of the carriage and arm assembly 80 and securing with height selector pin 95. Handle straps 204*a* or other attachments can be attached to the rotatable connection 205*a* at the end of the bar 201*a* to provide for more exercise options. This adjustable arrangement can accommodate exercisers of different sizes and fitness levels. Intensity of the exercise can be changed by changing the height or the width of the bars and/or attachments.

Bars 200*a*, 200*b* eliminate the need for specially designated chin-up or dip stations which are achieved here without changing the size of the machine and using the same adjustable structure for several different applications Referring still to FIG. 3*a*, 3*b*, the arm assembly 100*a* also includes pulley assembly 210*a* comprising bearing sleeve 211*a* with pulley housing 212*a*, which is rotatably mounted over the hollow shaft 213*a*, attached to the arm 101*a*, such that it is free to rotate relative to the arm 101*a* about axis A3 (parallel with the longitudinal axis of the arm 101*a*). At least one bearing 214*a*, although two are shown with the present invention, are mounted such that the outer ring is attached to the sleeve 211*a* and an inner ring attached to the hollow shaft 213*a* and secured with external snap rings, such as external snap ring 243, shown in FIG. 3*b* (other external snap ring(s) not shown) at the end of the hollow shaft 213*a*. Two pulleys 215*a*, 215*b* (FIG. 4) are rotatably mounted with bolts inside pulley housing 212*a*, and positioned so that they permit passage of the cable between them. Pulley 215*a* is mounted such that axis of rotation A3 is coincident with the axis of the cable 141 when engaged with the pulley 215*a*. Pulley 216*a* is preferably smaller than pulley 215*a* and is positioned such that it engages with the cable 141 when the applied pulling angle of cable 141 can no longer be supported by pulley 215*a*. Pulleys 215*a*, 216*a* always guarantee cable engagement at most commonly used angles for a particular exercise.

Referring now to FIG. 3*a*, the handle unit 130*a* will be described with the understanding that the description is equally applicable to the handle unit 130*b*. The handle unit 130*a* includes handle 131*a*, flexible strap 132*a* attached to each end of handle 131*a* and formed into a loop and stopper 133*a* that is fitted over strap 132*a* and attached to the end of cable 141. From this position it can be grasped by an exerciser, and when pulled will cause rotation of pulley assembly 210*a* about axis A3 (FIG. 1, 2) and allow the direction of the cable to align with the direction of the pulling force exerted by the exerciser via handle unit 130*a*. Different handle attachments can be used with present invention, for example, different lengths of soft single grip handles, ankle straps, horse shoe handles, rope attachments and different types of pull down bars.

Referring now to FIG. 1, 2 the swing-away bench assembly will be described. Those skilled in the art will understand that the described bench is an example of a workout station which can be used with the present invention and that the subject of the invention is the method of bringing the workout station to the exercise position and removal of the entire station (not partial) to the storage position.

Referring now to FIG. 1, 2 bench assembly 180 will be described. Bench assembly 180 comprising seat 181 coupled with back support 182 at the pivot bracket 185 which is mounted on seat support 186. Two vertical supports 187*a*, 187*b* are attached to the seat support 186 at the top end and to the sliding sleeve 188 at the bottom end. Tilt selector plate 183 with tilt selector pin 184 attached to selector bracket 189 is mounted at the front of the vertical support 187*a*. Slide selector pin 197 is attached to sliding sleeve 188 and guided by holding bracket 198 attached to vertical support 187*b*. Bench assembly 180 allows for angular adjustment of seat 181 and back support 182 about pivot bracket 185 using tilt selector pin 184 inserted retractably in one of the openings in tilt selector plate 183. Depth adjustment of the bench assembly 180 is also provided and can be accomplished by changing position of sliding sleeve 188 mounted over swing able arm 193. Position of sliding sleeve 188 can be selected and secured with retractably mounted slide selector pin 197 inserted in one of the selector holes (not shown) in the swing-able arm 193.

Figure 8:
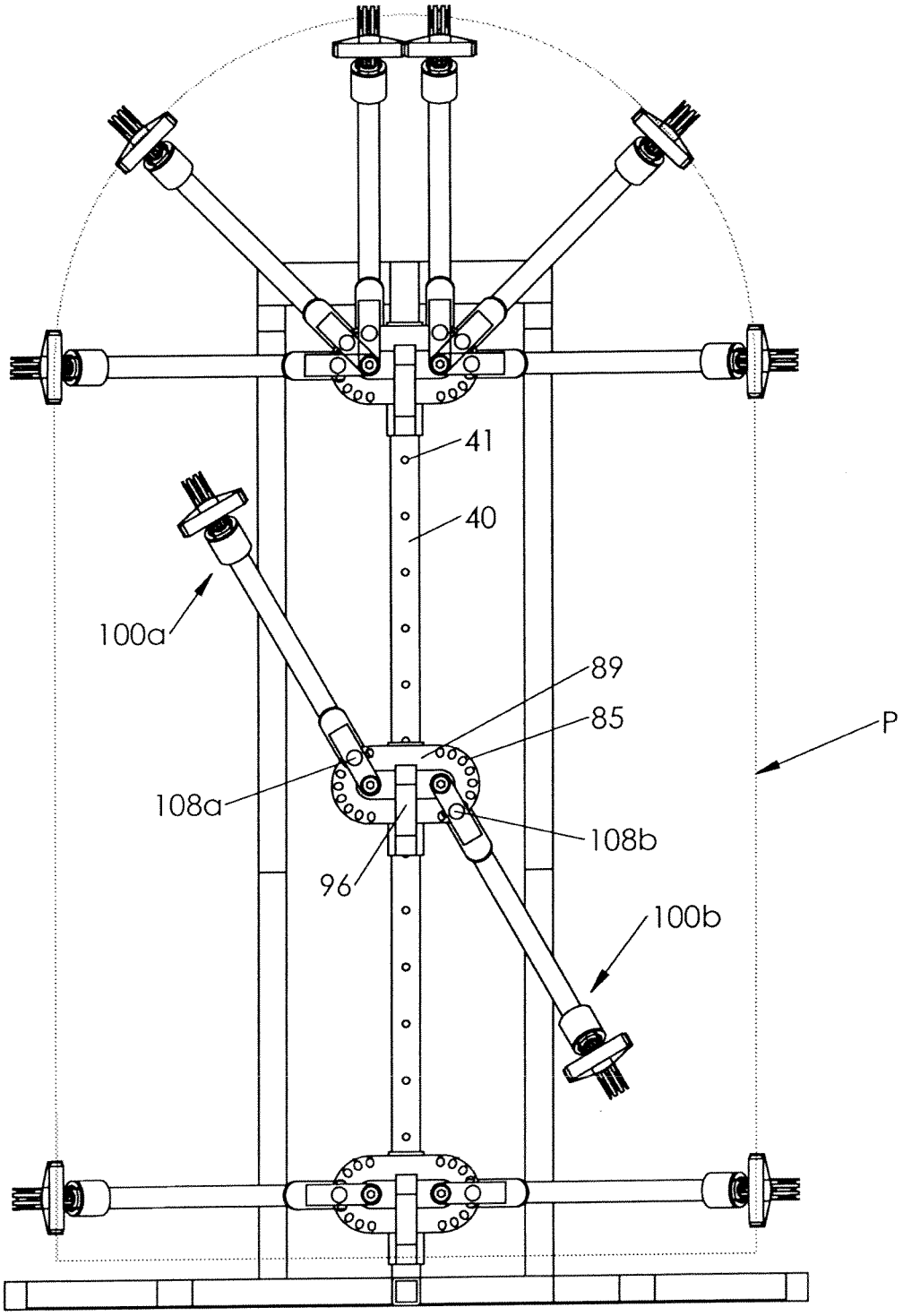
FIG. 8 and FIG. 9 are front and right side views, respectively, of the exercise machine with multiple carriage positions and configurations shown to illustrate the plane of possible exercises.

Described above bench assembly 180 is just an exemplary workout station that can be utilized with present invention and is used to describe a concept of creating an actual multi station exercise machine by bringing in specific workout stations that can be stored at both sides of the machine from storage position to the exercise position and use them as a regular stationary workout station, for example, bench press exercises can be done with bench assembly 180 in workout position (FIG. 1) or with bench assembly 180 swung to storage position (FIG. 2) and the freed space in front of the machine can be utilized for a number of undisturbed functional exercises (FIG. 8, 9).

Those skilled in this art will appreciate that the described above bench assembly 180 is just one of many possible types of workout benches that can be used with the present invention and can be stored on either sides and is used here as an example to explain the concept and method of creating combined multi-station exercise machine and functional trainer all in one without increasing space requirement and using just the original footprint of the present invention. Almost any commonly used types of exercise benches or stationary attachments can be used with present invention including benches with leg extension attachment, fold-up type benches with adjustable and removable back support and rowing capability.

Referring now to FIG. 1, 2 when bench assembly 180 (or any other suitable bench) is connected to a swing able arm 193 it creates swing-away workout station 190, comprising entire bench assembly 180 connected to the swing able arm 193 with sleeve 188. Bench assembly 180 can also be connected with swing able arm 193 with bolts, welts, or clamps and those skilled in this art will appreciate that the sleeve connection is just an example to better explain the concept of present invention and shouldn't be limited to such. Swing-away workout station 190 further comprising pivot pin 191 connecting swing able arm 193 with one end of the stationary mount 192 which is attached to the central reinforcement 34 at the other end. Swing able arm 193 can be locked at the workout position with retractable locking pin 196 connecting lock 194 located at the end of the swing able arm 193 to the stationary lock receiver 195 located at the end of the central reinforcement 34. With locking pin 196 retracted, swing-away workout station 190 can be moved to storage position on the side of the present invention. The pivotal connection between stationary mount 192 and swing able arm 193 via pivot pin 191 provides a delivery system for most benches or workout stations that when attached to the swing able arm 193 can be brought to workout position(FIG 1) or from workout position to storage position(FIG 2). The described above components of the delivery system are designed so that swing able workout station 190 when moved to or from workout position, rarely interferes with arms 100*a*, 100*b* and when in workout position there is still enough room provided for most of the adjustments of arms 100*a*, 100*b* and carriage and arm assembly 80 needed for different exercises.

Operation

Referring now to FIG. 1, 2, 4 the operation of the present invention will now be described. Single cable 141 couples both of the handle units 130*a*, 130*b* with the weight stack assembly 170. Cable 141 extends from the handle unit 130*a*, in between pulleys 216*a*, 215*a* through bearing sleeve 211*a* coincident with axis A1, through arm 101*a*, and engages with pulley 103*a* mounted between front and rear supports 104*a*, 105*a* of the arm mounting bracket 102*a*. Cable 141 passes through sleeve bushing 95*a*, coincident with axis A1 and engages with pulley 93*a* mounted at the pulley mount 88 of carriage and arm assembly 80. Pulley 93*a* can be moved vertically (up or down) with the carriage and arm assembly 80 without changing the tension in cable 141. Cable 141 then travels upwardly and engages and passes over right front pulley 73*a* of the upper pulley assembly 70. After passing pulley 73*a*, cable 141 travels downwardly, engages and passes below pulley 122*a* of cable compensator assembly 120. The cable then travels upwardly and passes over right rear pulley 73*b* of the upper pulley assembly 70. From there, the cable 141 travels downwardly, engages, and passes below weight stack pulley 176 and travels upwardly to the left rear pulley 73*c* of the upper pulley assembly 70. Cable 141 then passes over pulley 73*c* and travels downwardly, engages, and passes below upper left compensator pulley 122*b* of cable compensator assembly 120. Cable 141 then travels upwardly, engages, and passes over left front pulley 73*d* of the upper pulley assembly 70. Cable 141 then travels downwardly, engages, and passes below pulley 93*b* mounted at pulley mount 88 of carriage and arm assembly 80. Pulley 93*b* can travel vertically (up or down) with carriage and arm assembly 80 without changing the tension of cable 141. Cable 141 then travels along axis A2, engages with pulley 103*b*, and travels along axis A4 of arm 100*b*. Cable 141 extends through pulley housing 212*b* between pulleys 215*b*, 216*b* and terminates at handle 130*b*.

Figure 5:
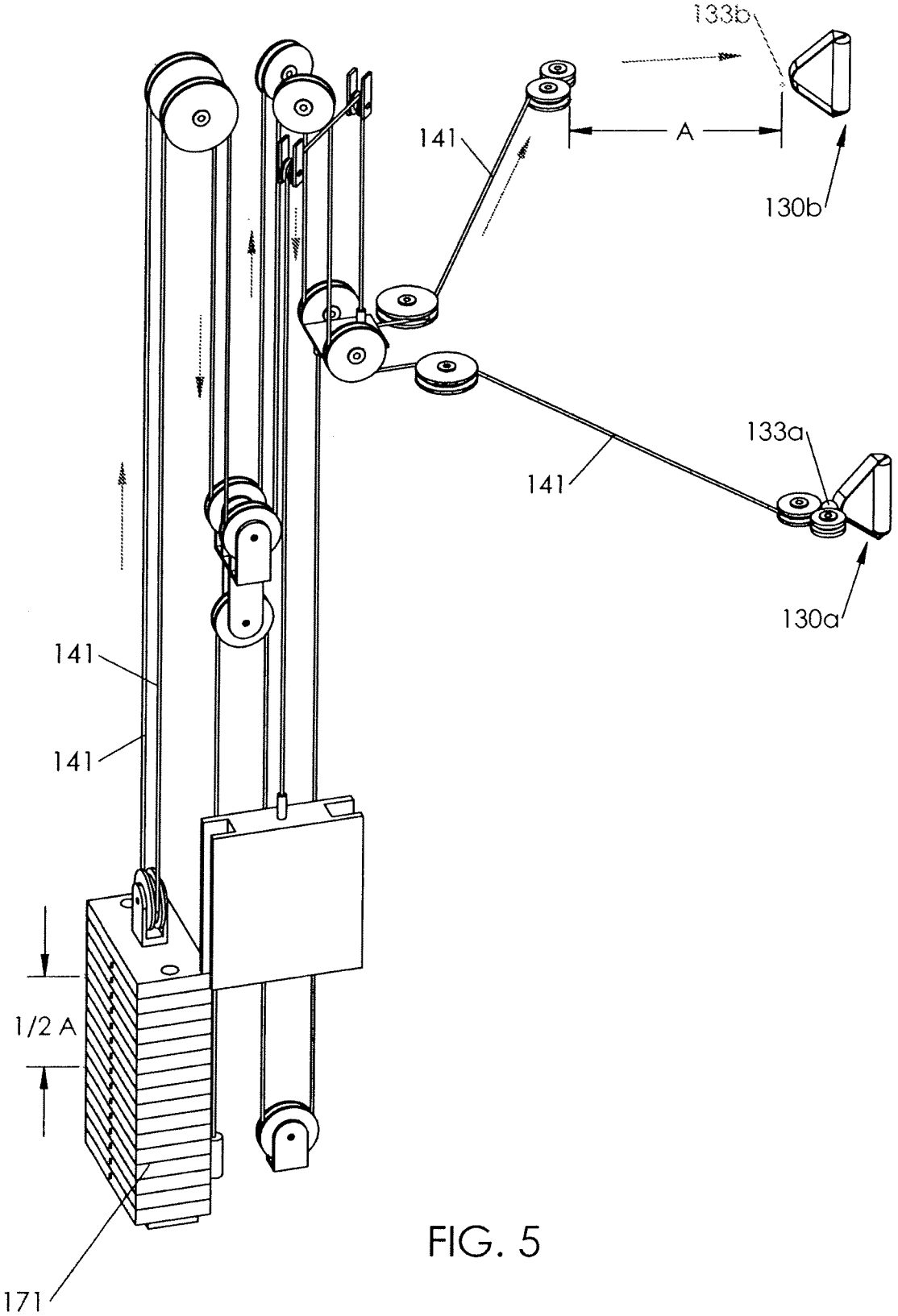
FIG. 5 is a schematic view of the cabling independent of the frame and arm structures where the handle of one arm is pulled out and the handle of the other arm is not pulled out and with the weight selected is raised to half of the distance the handle is pulled.

FIG. 5, 6 show one of the selected positions for exercise. The exerciser can grasp one or both of the handle units 130*a*, 130*b*, and pull them away from the ends of arms 100*a*, 100*b*. The grasping can be accomplished by one or both of the exercisers hands or feet as desired for the given exercise. The respective ends of cable 141 are provided with stoppers 133*a*, 133*b*. As those skilled in the art will readily appreciate that stoppers 133*a*, 133*b* control the motion of cable 141 to allow exercise by pulling one end of the cable separately or both ends at the same time. FIG. 5 illustrates the use of just one handle unit 130*b*. When one end of the cable 141 is pulled at the handle unit 130*b* the second end is anchored at the stopper 133*a*. Force exerted at handle unit 130*b* transfers through cable 141 to weight stack assembly 170 and causes the selected weight to rise. In the event that only one hand or foot is used the illustrated arrangement of the pulleys reduces the selected resistance by fifty percent. (e.g. For each ten pounds of weight selected, the exerciser experiences five pounds of resistance.) And for every distance traveled by the end of the cable 141, weight stack assembly 170 will travel half of that distance (marked as A and ½A in FIG. 5).

Figure 6:
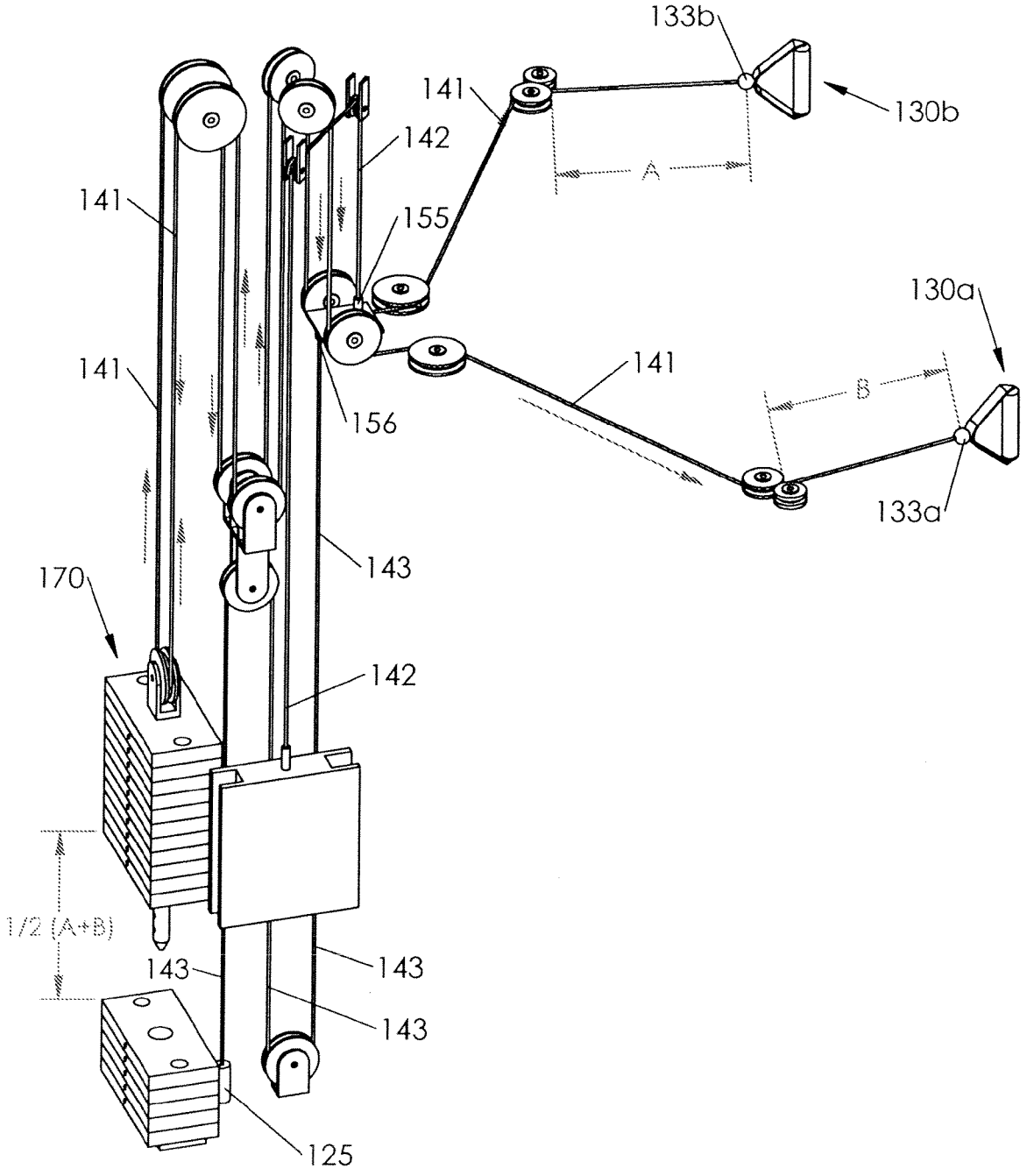
FIG. 6 is a schematic view of the cabling independent of the frame and arm structures where the handles of both arms are pulled out from the ends of the arms with the weight selected raised to half of the combined distance the handles are pulled.
Figure 7:
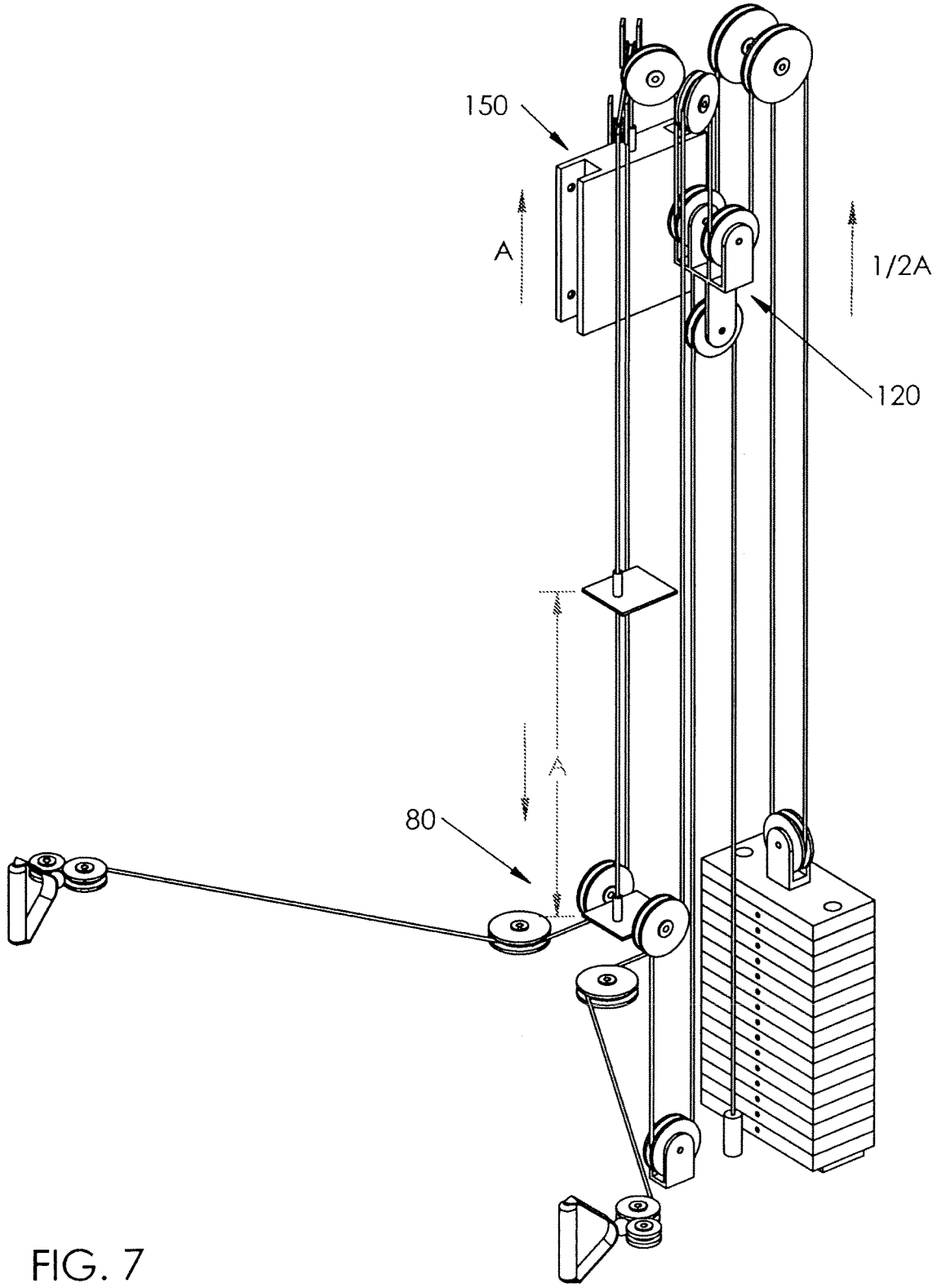
FIG. 7 is a schematic view of a simplified carriage and arm assembly in a lower position on the centre post with a counterbalance and cable compensator adjusted accordingly.

In the event that both handles 130*a*, 130*b* are used at the same time, handle units 130*a*, 130*b* are engaged and pulled away from their respective arms 100*a*, 100*b*. When the exerciser uses both hands or feet, the arrangement of the pulley train transfers one hundred percent of the pre-selected resistance at weight stack 170 to handle units 130*a*, 130*b*. (e.g. For each ten pounds of weight selected, the exerciser experiences ten pounds of total resistance typically five pounds in each handle unit 130*a*, 130*b*.) FIG. 6 shows an example when both handles are used at the same time. When handle units 130*a*, 130*b* are pulled at different distances, than the distance travelled by the weight stack is equal to ½(A+B), where A and B are the distances travelled by handle units 130*a*, 130*b*, respectively. When the distance travelled by the handle units 130*a*, 130*b* is equal (distance A equal distance B) the distance travelled by the weight stack is equal to the distance travelled by one of the handles.

Normally vertical adjustment of the carriage and arm assembly 80 would change tension in cable 141 and the length of cable available for exercise. Cable compensator assembly 120 is used to maintain the tension in cable 141 and a constant length of cable available for the exercise. Cable 141 at its midsection creates a downward U-shape loop between pulleys 73*a*, 73*b*, 73*c*, 73*d* at the top and engages with pulleys 122*a*, 122*b* of the cable compensator assembly 120 at the bottom of the loop. Cable compensator assembly 120 interconnects cable 141 with anchor cable 143 via pulleys 122*a*, 122*b*, 123 rotatably mounted to bracket 121. Anchor cable 143 interconnects carriage and arm assembly 80 via pulleys 124, 123 and cable anchor 125, with frame member 34. Cable 141 and anchor cable 143 interact together via cable compensator assembly 120. When carriage and arm assembly 80 is moved upward or downward from any location on vertical post 40, cable compensator assembly 120 travels in the opposite direction and one half of the distance traveled by the carriage and arm assembly 80. Anchor cable 143 anchors cable compensator assembly 120 in fixed position at any preselected height of the carriage and arm assembly 80 and enables cable 141 to transfer resistance from weight stack 170 (source of resistance) to the handle units 130*a*, 130*b* used by exerciser. Cable compensator assembly 120 compensates both halves of cable 141 at the same time without changing the tension or length of the cable available for exercise.

Figure 11:
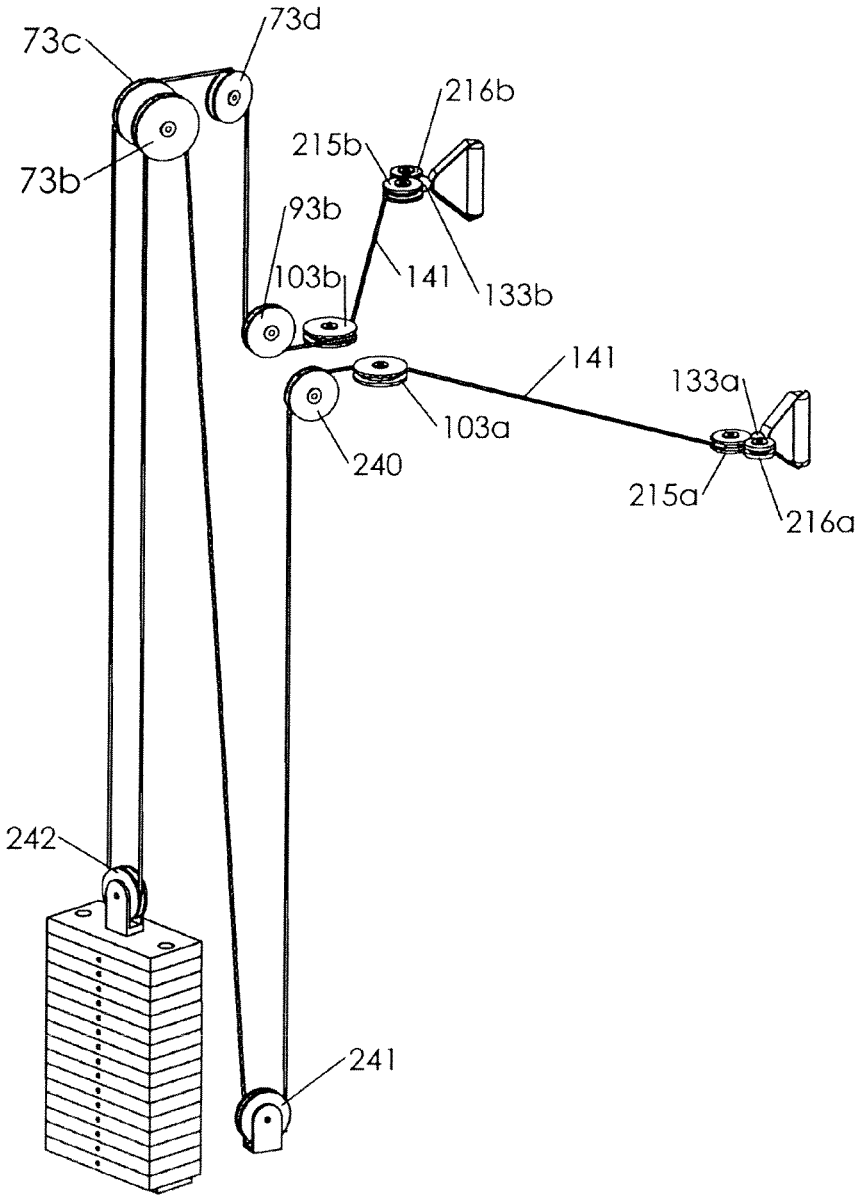
FIG. 11 is an alternative embodiment for maintaining tension and a constant length of cable available for exercise.

Referring now to FIG. 11 the alternative embodiment for maintaining tension and a constant length of cable available for exercise will be described. Cable 141, anchored between pulley 215*a*, 216*a* with a stopper 133*a* at one end, extends along axis A3 and engages pulley 103*a*. It travels along axis A1 over the top of pulley 240, travels downwardly and engages and passes below pulley 241. Cable 141 then travels upwardly and engages and passes over the right rear pulley 73*b* and extends downwardly passing below the weight stack pulley 242 and travels upwardly to the left rear pulley 73*c*. It then extends horizontally and engages and passes over the left front pulley 73*d* and travels downwardly and engages and passes below pulley 93*b*. Cable 141 then travels along axis A2, engages with pulley 103*b* and travels along axis A4, extends between pulleys 215*b*, 216*b* and terminates at the stopper 133*b*. Pulleys 240 and 93*b* can travel vertically (up and down) with the carriage and arm assembly 80 without changing the tension of cable 141. During adjustments cable 141 engages and travels along pulley 241, 73*b*, 242, 73*c*, 73*d*, while anchors 133*a* and 133*b* remain at their original positions.

Referring to FIG. 1, 2, 3*a*, 4. In order to provide for safe and effortless vertical adjustment of the carriage and arm assembly 80, counterbalance assembly 150 is provided. The counterbalance assembly 150 comprising a counterweight 151, rollers 152*a*, 152*b*, 152*c*, 152*d* upper reinforcement 117, lower reinforcement 118, a pair of guide rails 115,116, and transfer pulleys 153,154. The guide rails 115,116 connect at the top of upper reinforcement 117 and at the bottom of lower reinforcement 118. The counterweight 151 and rollers 152*a*, 152*b*, 152*c*, 152*d* are operatively connected and sized to provide rolling operation with guide rails 115,116. Cable 142 is attached to cable anchor 155 of pulley mount 88. Cable 142 extends upwardly, engages, and passes over transfer pulley 154 which is mounted to the underside of cover plate 42 which is attached to upper frame reinforcement 60. Cable 142 then travels horizontally, engages, and passes over transfer pulley 153 mounted to upper reinforcement 117 and extends downwardly and terminates at cable anchor 119 attached to counterweight 151.

Figure 10A:
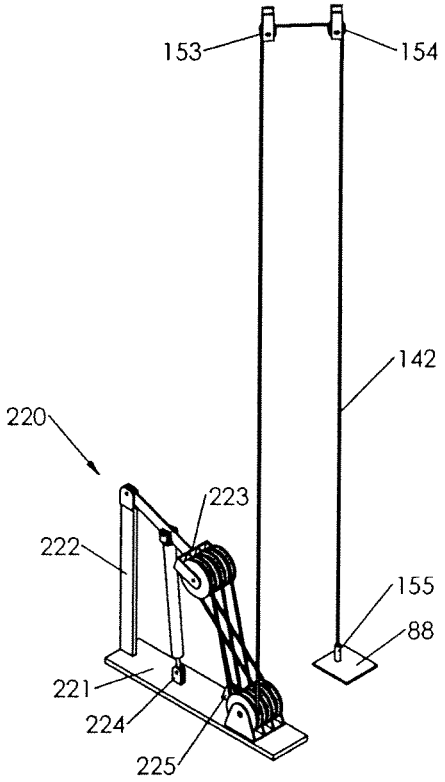
FIG. 10*a* and FIG. 10*b* is a schematic of an alternative counter balance assembly.
Figure 10B:
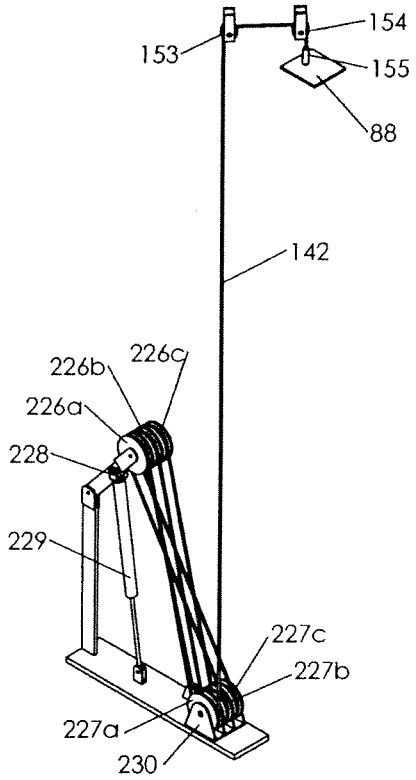

Carriage and arm assembly 80 is interconnect via cable 142 and transfer pulleys 153, 154 with counterweight 151, and during vertical adjustments of the carriage and arm assembly 80 they travel the same distance but in opposite directions. The weight of the carriage and arm assembly 80 is approximately equal to the weight of the counterweight 151. Those skilled in this art will readily appreciate the described above counter balance assembly 150 is used to explain the operation of present invention as there are other methods which could be used without departing from the spirit of the invention. For example; devices that combine pulleys with gas springs. Referring to FIG. 10*a*, 10*b* alternative counterbalance assembly 220 can be used instead of counter balance 150. Alternative counter balance assembly 220 comprising base plate, 221, stationary arm 222, movable arm 223, gas spring cylinder 229, two sets of three pulleys 226*a,b,c* and 227*a,b,c*, triple pulley mount 230 and cable mount bracket 225. Bottom end of the stationary arm 222 is attached to the base plate 221 with the top end pivotally connected with first end of the movable arm 223. Second end of the movable arm 223 is shaped and sized to accommodate three pulleys 226*a,b,c*. Gas spring cylinder 229 is pivotally attached through the fork bracket 228 to the mid section of the movable arm 223 at the top end and to base plate 221 via base bracket 224. Triple pulley mount 230 with pulleys 227*a,b,c* is mounted to base plate 221 at the far end from stationary arm 222. Cable 142 is attached to base plate 221 via base bracket 225 passing over and engaging pulleys 226*c,* 227*c,* 226*b,* 227*b,* 226*a,* 227*a,* respectively, and exits and passes over transfer pulleys 153, 154 and terminates at the cable anchor 155 of pulley mount 88. Pulley mount 88 illustrates positions of carriage and arm assembly 80 and is interconnected via cable 142, transfer pulleys 153, 154 pulleys 227*a,b,c* and 226*a,b,c* via movable arm 223 with gas spring cylinder 229. Because of the pulley ratio of five to one (5:1), for every inch of travel of gas spring cylinder 229, carriage and arm assembly 80 illustrated by pulley mount 88 will travel respectively five inches. Also, resistance created by the gas spring cylinder 229, pulleys 226*a,b,c*, 227*a,b,c* and movable arm 223 equalizes resistance of the moving carriage and arm assembly 80. Other devices may also include winch type mechanisms (mechanical, electrical with cord or rechargeable batteries as a source of power), mechanical springs and pulleys, and commercially available spring balancers, elastic bands and elastic bands with pulleys, electric servo motors and remotely controlled electric motors with brakes.

The present invention can be adjusted to many different positions to perform a variety of exercises. Referring now to FIG. 1, 2, 8, 9. To select desired width for exercise, arms 100*a,* 100*b* can be rotated about axes Al and A2 and locked in a pre-selected position. In order to rotate the arms 100*a* and 100*b* to different positions, the exerciser removes pins 108*a,* 108*b* from apertures 85 in selector plate 89. With pin 108*a* withdrawn from apertures 85 in selector plate 89, arm 100*a* is free to rotate about axis A1 over an arc of approximately 180 degrees and can be locked in one of the series of pre-selected positions based on increments defined by the apertures 85. In the present invention increments of 22.5 degrees are used but any other practical spacing can be used. Arm 100*b* can be adjusted the same way like arm 100*a* described above. Each of the arms 100*a* and 100*b* can be rotated about axis A1 and A2 and locked in a selected position irrespectively from each other and regardless of their width and position of the carriage and arm assembly 80 on the vertical post 40 without changing the tension in cable 141.

After pre-selecting the width of the arms 100*a,* 100*b* the exerciser can adjust the carriage and arm assembly 80 to a proper height for the exercise. To change the vertical (height) position of the carriage and arm assembly 80, exerciser has to remove carriage selector pin 95 from the apertures 41 in vertical post 40 which can be accomplished by manipulating handle 96 connected via linkage 97 with carriage selector pin 95. With carriage selector pin 95 disengaged from apertures 41, carriage and arm assembly 80 is free to move up or down along vertical post 40 engaging rollers 82*a,* 82*b,* 82*c*.

Described above 3 point arm adjustment method is very effective in creating new positions for exercise. As it can be seen, different height positions of the carriage and arm assembly 80 combined with different configurations of the adjustable arms 100*a,* 100*b* provide multiple widths for low and high pulley exercises as well as multiple heights for narrow and wide grip exercises. As it should be noted, prior art machines would require adjustments at four locations (points) to achieve a similar number of positions available for exercise.

Figure 4:
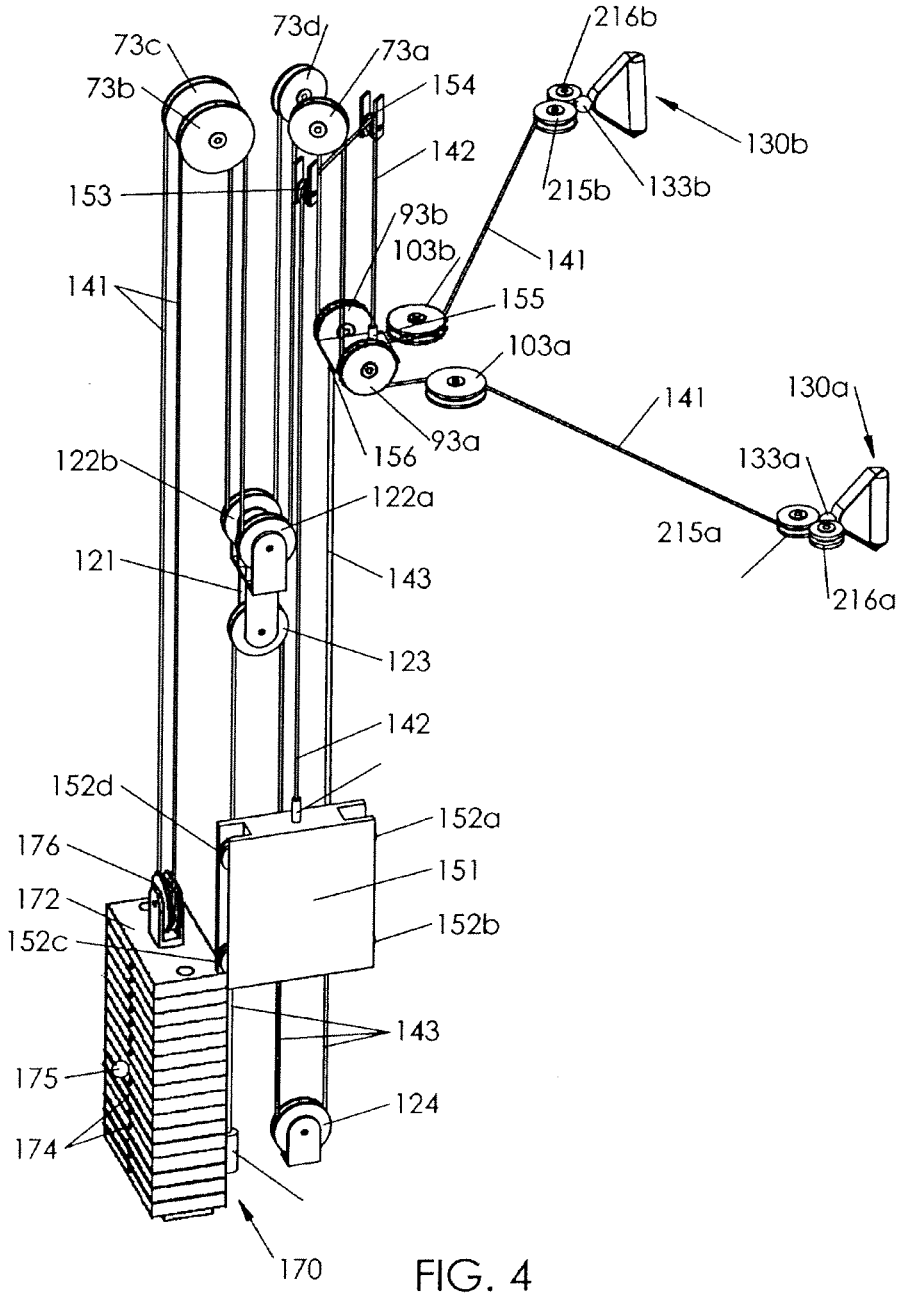
FIG. 4 is a schematic view of the cabling independent of the frame and arm structures where the handles of both arms are not pulled out from the ends of the arms.

One point height adjustment for carriage and arm assembly 80 with unchanged configuration of arms 100*a,* 100*b* greatly shortens transition time between exercises and can simplify more complex workout routines, such as circuit training With one point height adjustment, exerciser can switch in seconds from low to mid or even high pulley exercises which with prior art, equipment would require at least two separate adjustments. As it can be seen in FIG. 8, 9, all starting positions for exercise lie in one plane P (Indicated by straight vertical line in FIG. 9). This arrangement makes all the adjustments for new positions for exercise easily predictable by the exerciser and it greatly simplifies the use of the bench which doesn't need to be moved to fit new arm positions. Ends of arms 100*a,* 100*b* can easily reach settings for high pulley exercises with three adjustment points (at pins 108*a*, 109*b* and handle 96) placed at one convenient location. High pulley level can be adjusted by each exerciser to meet their individual needs. With the presented adjustment method for creating new positions for exercise, handles 131*a,* 131*b* at the ends of arms 100*a,* 100*b* can be brought within a view inches from the starting position for exercise which allows for greater economical use available for exercise cable length of cable 141 (FIG. 4). This ability can be used and appreciated in the fields of rehabilitation and physiotherapy where precise positioning, proper form and execution of the path of the exercise is very important.

As it can be seen in FIG. 9, present invention is always ready (by providing sufficient space in front of the machine) for various lifting or pulling exercises that require pure vertical resistance without additional attachments or changing of the body positions of the exerciser (as seen in some of the prior art machines). As seen, the presented machine offers full range of undisturbed (by bench) functional exercises without sacrificing their proper form.

Present invention also offers wide range of bench exercises. As it can be seen in FIG. 1, 2, in order to perform bench exercises, exerciser has to bring swing away workout station 190 from storage position (FIG. 2) to exercise position (FIG. 1). Those skilled in the art will understand that the described bench is just an example of a workout station which can be used with the present invention and that the subject of the invention is the method of bringing the workout station to the exercise position(FIG. 1) and removal of the entire station (not partial) to the storage position (FIG. 2).

Bench assembly 180 is connected to swing able arm 193 and can be easily moved from storage to workout position by exerciser by rotating entire swing away workout station 190 about pivot point 191 and securing its position by inserting retractable locking pin 196 into stationary lock receiver 195 located at the end of central reinforcement 34. At this position, exerciser can select proper angle for back support 182 by inserting tilt selector pin 184 into one of the apertures in tilt selector plate 183. Those skilled in the art will recognize that the shape and size of the swing able arm 193 can be determined by the type of workout station used with the present invention. Bench assembly 180 can be also adjusted closer or farther away from vertical post 40 and carriage and arm assembly 80 for providing exerciser with more options and ability to maintain proper form during exercises. Position of sliding sleeve 188 can be selected and secured with retractably mounted slide selector pin 197 inserted in one of the selector holes (not shown) in swing able arm 193. Even with bench assembly 180 in workout position most of the adjustments for carriage and arm assembly 80 can be accomplished.

Exerciser can also preselect the configuration of carriage and arm assembly 80 before placing the bench assembly 180 into workout position.

Because of the described previously capability of carriage and arm assembly 80 to adjust for different positions for exercise, exerciser can perform bench exercises using wide to narrow grip options and can simulate incline, decline and flat bench positions by changing the height of carriage and arm assembly 80. Handle units 130*a*, 130*b* can align themselves with the angle of cable 141 when pulled or pushed by the exerciser, which gives more exercise options for the exerciser. Because handle units 130*a*, 130*b* rotate in one plane P (FIG. 8, 9), exerciser can easily predict new positions of the arms and don't need to adjust their body positions to the new location of the arms(like it can be seen in some of the prior art machines described before).

Referring to FIG. 1, 2, 3*a*. The present invention can also be used for non-weight lifting exercises such as: chin up's, dips, push up's, reverse push up's and abdominals. For these exercises the bench assembly 180 has to be in storage position and bars 201*a*, 201*b* (201*b* not shown) have to be attached to the arms 100*a*, 100*b*. Exerciser then sets arms 100*a*, 100*b* to a desired width and carriage and arm assembly 80 to a suitable height and can perform a chosen exercise using bars 201*a*, 201*b* (201*b* not shown) detachable handles 204*a*, 204*b* or other attachments like different lengths of chain with handles, sleeves for hang-down abdominal exercises and detachable bars of different lengths.

In order to do all mentioned exercises with prior art equipment, extra dip, chin up, push up, reverse push up and abdominal stations are usually added to the side or back of the machine taking more space and making the machine more costly to build. Prior art equipment lacks the adjustability required for different exerciser size and the level of intensity of the exercise cannot be changed. Present invention overcomes shortcomings of the prior art by using adjustability of the carriage and arm assembly 80 without adding extra stations. This design saves space by attaching bars 201*a*, 201*b* (201*b* not shown) to arms 100*a*, 100*b* and using the adjustability of the carriage and arm assembly 80 to create different positions for exercises instead of adding extra stations which always add to the cost and space requirement of the machine. Simple adjustments of the carriage and arm assembly 80 allow the exerciser to set the machine to better fit their size and fitness level. Users can easily adjust the machine to their size and add more variations to their exercises by changing their body position and resistance.

Body weight exercises are very effective but can be challenging for beginners, that's why the ability to change resistance and positions without adding extra stations and increasing the size of the machine is a very useful and is not addressed this way by prior art. For example; to decrease resistance of the dips, the exercisers can lower the position of the carriage and arm assembly 80 and put their feet flat on the floor and to increase resistance carriage and arm assembly 80 can be positioned higher. To increase the resistance of the push up and reverse push up, bars 201*a*, 201*b* (201*b* not shown) can be lowered by lowering carriage and arm assembly 80, to decrease resistance of the push up and reverse push up bars 201*a*, 201*b* (201*b* not shown) can be raised by adjusting height of carriage and arm assembly 80.

Adjustability of present invention can be also used with high speed exercises and stretching. High speed exercises are often used for sport specific applications like boxing, martial arts, golf swing, physiotherapy and rehabilitation, or just for low impact toning and shaping exercises. However, the traditional weight stack cannot be used safely in this application because of the generated momentum. The use of the safer ratio (4:1) reduces this problem, but because of the extra weight, it has only practical use in specialized gym equipment. Elastic tubes can be attached to the ends of the arms and used instead. Weight selected at the weight stack should be set to the maximum. All the positions available with the machine can be used with elastic tubes.

Thanks to the ability to change the height of both arms 100*a*, 100*b* at the same time with just one adjustment, present invention can mimic most of the positions provided by professional and specialized cage type stretching machines. The present invention can accommodate users of various sizes with simple adjustments/transformations. Arms 100*a*, 100*b* provide enough support and strength that any desirable position can be chosen by the exerciser for various stretching exercises.

Referring to FIG. 8, 9 an exercise Plane P is illustrated. Based on the configurations of carriage positions combined with the adjustable arms positions, it is evident that high and low pulley exercises as well as wide and narrow grip exercises are possible with the present arrangement without unnecessarily extending the lengths of arms 100*a*, 100*b*. Therefore, the present invention can be built shorter than typical exercises machines of this nature offering high and low pulley exercises using shorter and stronger arms, thereby offering a more compact, user-friendly, and economical design.

The present invention can be used for many different types of exercises which normally require a number of different fitness machines or devices. It can be used as a functional trainer machine for unrestricted user defined exercises with multi-directional and adjustable resistance. It provides multiple bench exercises including flat, incline and decline positions with narrow or wide grips ranging from any level between a low to high pulley location. It can also be used for non-weight lifting exercises such as chin-ups, pushups, reverse pushups and abdominals, with taking under consideration the size and the fitness level of the exerciser. When exerciser wants to perform high-speed exercises where traditional weight stack or free-weights cannot be used safely because of the generated momentum, elastic tubes can be attached at the end of the arms and used instead. The present invention can be used for various stretching exercises. What should be noted is that the present invention supports multiple functions using just one adjustable structure without increasing required floor space, while most prior art machines build additional structures for each application increasing the overall size and cost.

Alternative Embodiments

Machine can be built with two weight stacks (sources of resistance). It can be done by splitting cable 141 in half, eliminating pulley 176 connecting available ends of the cable with two sources of resistance.

It can be built with different configuration of pulleys with different load ratios. Pulleys can be positioned at different angles and at different locations as long as the cable compensation is maintained and changes of the angular arm positions 100*a*, 100*b* and adjustments (up or down) of the carriage and arm assembly 80 don't change the tension in cable 141 (or split cable 141) when two sources of resistance are used. Connection at the source of resistance always terminates at the same location before and after exercise. Load ratios can be changed by adding or removing pulleys and changing the length of the cable. Science of pulleys has been known for thousands of years and mechanical engineering books provide adequate information on how to build various pulley trains with different load ratios.

Angle of arms 100*a*, 100*b* can be changed by either changing the angle between arm and axis A1, A2, or changing the angle of axis A1, A2 from the horizontal position.

Handle units 130*a*, 130*b* can be built with just one pulley.

Vertical post 40 can also be built in any other practical position other than the vertical position. Also, additional vertical posts, guide posts or any other practical posts may be added for stability, strength and overall reinforcement.

Additional/different locking mechanisms can be used to secure carriage and arm assembly 80. These mechanisms can include; cam locks, screw in locking pins, push button with electric brake, compression pads, screw or cam activate and others.

Numbers of rollers guiding carriage and arm assembly 80 on vertical post 40 can be different than the three used in the present invention. Also an additional guide post can be placed behind vertical post 40 and guide rollers can run on the inside surfaces between the two posts.

Rollers 82*a*, 82*b*, 82*c* and vertical post 40 can be of different shape and different profile for better and more stable rolling action. Also different devices can be used for guiding like; sleeve bearings, guide bushings, linear bearings and others.

Counterbalance assembly 150 can be operated with remote control electric motor.

Arms 100*a*, 100*b* can have additional anchoring points for attaching resistance bands. They can be located at bearing sleeve 211*a*, 211*b* and at any suitable location on the carriage and arm assembly 80.

Other multifunctional benches and exercise stations may be adopted and designed to work with the present invention.

Machine can be designed and built without a multifunctional bench and dip bars.

Different materials, sizes and interconnections can be used for all components.

Machine can be built so that the axis of rotation A1, A2 are not parallel to each other.

Machine can be built in a 'light duty version' for lighter loads. Different lighter materials like aluminum or plastics can be used to build carriage and arm assembly 80. Machine like this can work without counter balance assembly 150.

The invention claimed is:

1. A three-point adjustment multipurpose exercise machine, comprising:

a frame comprising a substantially upright post defining a substantially vertical axis;

a sliding carriage assembly slidably mounted on the upright post for movement along the substantially vertical axis;

a first locking device configured for releasably locking the sliding carriage assembly at a selected height on the upright post;

a first arm assembly comprising a first handle unit and a first arm rotatably mounted on the sliding carriage assembly for rotation about a first pivot axis;

a second locking device configured for releasably locking the first arm assembly at a selected rotated position about the first pivot axis;

a second arm assembly comprising a second handle unit and a second arm rotatably mounted on the sliding carriage assembly for rotation about a second pivot axis;

a third locking device configured for releasably locking the second arm assembly at a selected rotated position about the second pivot axis;

a source of exercise resistance;

a cable assembly coupling the first handle unit, the second handle unit, and the source of exercise resistance; and means for keeping tension in the cable assembly substantially the same irrespective of the selected height for the sliding carriage assembly, wherein the selected rotated positions for the first and second arm assemblies, about the respective first and second pivot axes, defines a horizontal span between the first and second handle units.

2. The exercise machine according to claim 1, wherein the first and second pivot axes are substantially parallel.

3. The exercise machine according to claim 1, wherein the first and second pivot axes are substantially horizontal.

4. The exercise machine according to claim 1, further comprising:

a first chin-up and dip bar assembly associated with the first arm assembly; and a second chin-up and dip bar assembly associated with the second arm assembly.

5. The exercise machine according to claim 1, further comprising:

a bench rotatably mounted to the frame; and a fourth locking device for releasably locking the bench in position for use in performing an exercise.

6. The exercise machine according to claim 1, further comprising rollers associated with either the upright post or the sliding carriage assembly, the rollers configured to aid the movement of the sliding carriage assembly along the substantially vertical axis.

7. The exercise machine according to claim 1, further comprising a counterbalance assembly associated with the sliding carriage assembly, the counterbalance assembly configured to aid the movement of the sliding carriage assembly along the substantially vertical axis.

8. The exercise machine according to claim 7, wherein the counterbalance assembly comprises a counterweight.

9. The exercise machine according to claim 7, wherein the counterbalance assembly comprises a gas spring cylinder.

10. The exercise machine according to claim 1, wherein the first locking device comprises a spring-loaded pin configured to engage at least one corresponding aperture.

11. The exercise machine according to claim 1, wherein the second and third locking devices each comprisse a spring-loaded pin configured to engage at least one corresponding aperture.

12. The exercise machine according to claim 1, wherein the means for keeping tension in the cable assembly substantially the same irrespective of the selected height for the sliding carriage assembly, comprises a cable compensator assembly comprising:

a cable having a first end coupled to the sliding carriage assembly and a second end anchored to the frame; and one or more pulleys associated with the cable.

13. A three-point adjustment multipurpose exercise machine, comprising:

a frame comprising a substantially upright post defining a substantially vertical axis;

a sliding carriage assembly slidably mounted on the upright post for movement along the substantially vertical axis;

a first locking device configured for releasably locking the sliding carriage assembly at a selected height on the upright post;

a first arm assembly comprising a first handle unit and a first arm rotatably mounted on the sliding carriage assembly for rotation about a first pivot axis;

a second locking device configured for releasably locking the first arm assembly at a selected rotated position about the first pivot axis;

a second arm assembly comprising a second handle unit and a second arm rotatably mounted on the sliding carriage assembly for rotation about a second pivot axis;

a third locking device configured for releasably locking the second arm assembly at a selected rotated position about the second pivot axis;

a source of exercise resistance; and a cable assembly coupling the first handle unit, the second handle unit, and the source of exercise resistance; and wherein the cable assembly is configured such that tension in the cable assembly remains substantially the same irrespective of the selected height for the sliding carriage assembly, wherein the selected rotated positions for the first and second arm assemblies, about the respective first and second pivot axes, defines a horizontal span between the first and second handle units.

14. The exercise machine according to claim 13, wherein the first and second pivot axes are substantially parallel.

15. The exercise machine according to claim 13, wherein the first and second pivot axes are substantially horizontal.

16. The exercise machine according to claim 13, further comprising:

a first chin-up and dip bar assembly associated with the first arm assembly; and a second chin-up and dip bar assembly associated with the second arm assembly.

17. The exercise machine according to claim 13, further comprising:

a bench rotatably mounted to the frame; and a fourth locking device for releasably locking the bench in position for use in performing an exercise.

18. The exercise machine according to claim 13, further comprising rollers associated with either the upright post or the sliding carriage assembly, the rollers configured to aid the movement of the sliding carriage assembly along the substantially vertical axis.

19. The exercise machine according to claim 13, further comprising a counterbalance assembly associated with the sliding carriage assembly, the counterbalance assembly configured to aid the movement of the sliding carriage assembly along the substantially vertical axis.

20. The exercise machine according to claim 19, wherein the counterbalance assembly comprises a counterweight.

21. The exercise machine according to claim 19, wherein the counterbalance assembly comprises a gas spring cylinder.

22. The exercise machine according to claim 13, wherein the first locking device comprises a spring-loaded pin configured to engage at least one corresponding aperture.

23. The exercise machine according to claim 13, wherein the second and third locking devices each comprises a spring-loaded pin configured to engage at least one corresponding aperture.

* * * * *